US006089131A

United States Patent [19]

Taimiot

[11] Patent Number: 6,089,131

[45] Date of Patent: Jul. 18, 2000

[54] RATCHETING WRENCH FOR DRIVING AN ELEMENT WITH A HEXAGONAL HEAD, IN PARTICULAR A BOLT OR NUT

[75] Inventor: Gilles Taimiot, Orly, France

[73] Assignee: Facom, Cedex, France

[21] Appl. No.: 08/981,458

[22] PCT Filed: Jun. 20, 1996

[86] PCT No.: PCT/FR96/00963

§ 371 Date: Apr. 7, 1998

§ 102(e) Date: Apr. 7, 1998

[87] PCT Pub. No.: WO97/00758

PCT Pub. Date: Jan. 9, 1997

[30] Foreign Application Priority Data

Jun. 23, 1995 [FR] France ..... 95 07603

[51] Int. Cl.[7] ..... B25B 13/00

[52] U.S. Cl. ..... 81/186; 81/119

[58] Field of Search ..... 81/186, 119, 125.1

[56] References Cited

U.S. PATENT DOCUMENTS

| | | | |
|---|---|---|---|
| 1,138,572 | 5/1915 | Kaylor | 81/125.1 |
| 1,954,141 | 4/1934 | Miquelon | 81/186 |
| 2,685,219 | 8/1954 | Diebold | 81/119 |
| 3,745,859 | 7/1973 | Evans et al. . | |
| 3,757,614 | 9/1973 | Evans et al. . | |
| 3,858,464 | 1/1975 | Evans | 81/119 |
| 3,921,476 | 11/1975 | Evans . | |
| 4,889,020 | 12/1989 | Baker . | |
| 5,551,322 | 9/1996 | Mikic et al. | 81/186 |
| 5,878,636 | 3/1999 | Baker | 81/186 |

FOREIGN PATENT DOCUMENTS

| | | |
|---|---|---|
| 580 177 | 7/1992 | European Pat. Off. . |
| 1446385 | 10/1966 | France . |
| 2143814 | 2/1973 | France . |

OTHER PUBLICATIONS

"Wrench Is Self–Ratcheting," Popular Science Magazine, p. 159, Aug. 1947.

*Primary Examiner*—David A. Scherbel
*Assistant Examiner*—Joni B. Danganan
*Attorney, Agent, or Firm*—Weneroth, Lind & Ponack, L.L.P.

[57] ABSTRACT

A ratchet wrench having an open end (18) defined by front (20) and rear (22) jaws, in relation to a driving direction. The jaws are linked by an intermediate arcuate web (24). Each jaw includes an engagement surface (30, 36) for engaging the front half of a front surface (32) and a rear surface (38), respectively, of the head of a part to be turned. A projection (42) is provided on the arcuate web for engaging a bearing point (43) on an intermediate head surface (44) located immediately ahead of the rear surface (38) when no torque is applied and over the full range of applied torques. The bearing point (43) of the projection (42) is located in the front half of the intermediate surface (44). The entire arcuate web (24) is spaced apart from the head (28), except at the bearing point (43), when torque is applied as well as when no torque is applied.

14 Claims, 3 Drawing Sheets

RATCHETING WRENCH FOR DRIVING AN ELEMENT WITH A HEXAGONAL HEAD, IN PARTICULAR A BOLT OR NUT

BACKGROUND OF THE INVENTION

The present invention concerns a ratcheting wrench for driving an element, in particular a bolt or nut, whose head comprises a hexagonal profile. The wrench has an open jaw structure defined by a front jaw and a rear jaw, relative to the driving direction, interconnected by a connecting arch. Each jaw comprises a driving surface adapted to cooperate with respectively a front face and a rear face of the driving profile in the front half of the faces relative to the driving direction. These two faces are opposed, and the jaw structure further comprises on the arch a complementary bearing curved convex protuberance adapted to cooperate, in the absence of torque and in the whole range of the applied driving torques, with a bearing point of the intermediate face of the driving profile situated immediately in front of the rear face relative to the driving direction.

Ratcheting wrenches, or rapid wrenches, are already known which permit the tightening or the untightening of a hexagonal bolt head or nut. They comprise a driving head provided with an open jaw structure in which the hexagonal element is inserted. In the driving direction, two opposite jaws of the jaw structure cooperate with the opposite faces of the hexagonal element for driving the latter. In the direction opposed to the driving direction, the jaws are disengaged from the faces of the hexagonal element and permit free rotation of the wrench about the latter. The driving surfaces of the jaws then slide along the faces of the hexagonal element.

These wrenches are particularly practical and convenient since they permit actuating, in one direction, a hexagonal element, by a simple back and forth movement of the wrench about the latter, and without ever having to completely disengage the head of the wrench from the hexagonal element.

A ratcheting wrench of the aforementioned type is described in the U.S. Pat. No. 3,921,476 in the name of EVANS. This wrench comprises an open jaw structure defined by two opposed jaws adapted to surround a hexagonal element. One of the jaws is provided with a recess for receiving an intersection corner of the six faces. This recess is defined on the jaw by two bosses on each side of the latter. These bosses are adapted to cooperate with areas of two adjacent faces interconnected by the corner received in the recess. These areas are located very close to this corner. Consequently, when the wrench is used, in particular when high torques are applied, the corner of the hexagonal element received in the recess is rapidly deteriorated.

SUMMARY OF THE INVENTION

An object of the present invention is to provide a ratcheting wrench which does not have the aforementionend drawbacks and permits in particular the transmission of the whole range of torques in an easy and stable manner with less risk of slip and deterioration of the faces and the corners of the hexagonal element.

For this purpose, the invention is a ratcheting wrench such as defined hereinbefore, characterized in that the bearing point of the intermediate face is situated in the front half of this intermediate face. The connecting arch being, at any place other than the bearing point, completely spaced away from the head both in the absence of torque and during the application of the torque.

According to particular embodiments, the present invention may have one or more of the following characteristics:

1) the protuberance is adapted to cooperate with the intermediate face in the vicinity of the front third of the latter, relative to the driving direction, for a head of maximum size;

2) the distance between the zone of contact of the rear driving surface with the rear face and the front corner of this rear face is less than the distance between the point of contact of the protuberance with the intermediate face and the front corner of this intermediate face;

3) the protuberance is in one piece with the arch;

4) there is provided on the arch between the rear driving surface and the protuberance a clearance extended by a concave connecting surface having in particular a radius of curvature that is less than or equal to the distance between the flats of the head, avoiding any contact between the jaw structure and the front corner of the rear face;

5) the front and rear driving surfaces are curved convex surfaces;

6) the radius of curvature of the rear driving surface is less than the radius of curvature of the front driving surface;

7) the angle, measured in the driving direction and defined between the axis of rotation of the polygonal head and the two zones of contact between the head and the rear and front driving surfaces, is slightly larger than 180°;

8) the profile of the jaw structure is formed by a succession of curved portions which are tangentially interconnected, from the front driving surface to the rear driving surface;

9) said jaw structure is disposed at one end of a wrench body which is provided at its other end with a ratcheting driving jaw structure of the same type and of another size, or with a box driving head;

10) the jaw structure has a fixed spacing;

11) the protuberance is adapted to cooperate with the intermediate face between one half and the front third of the latter, relative to the driving direction, for a head of maximum size; and 12) the protuberance is adapted to cooperate with the intermediate face substantially at the front four tenths of the latter, relative to the driving direction, for a head of maximum size.

Note that the document EP-A 0 580 177 in the name of SNAP-ON TOOLS CORPORATION describes a ratcheting wrench of a substantially different type since it does not include a complementary bearing point for the applied low torques and in the absence of torque.

BRIEF DESCRIPTION OF THE DRAWINGS

A better understanding of the invention will be had from a reading of the following description which is given solely by way of example with reference to the drawings, in which.

DETAILED DESCRIPTION OF THE INVENTION

Figure 1:
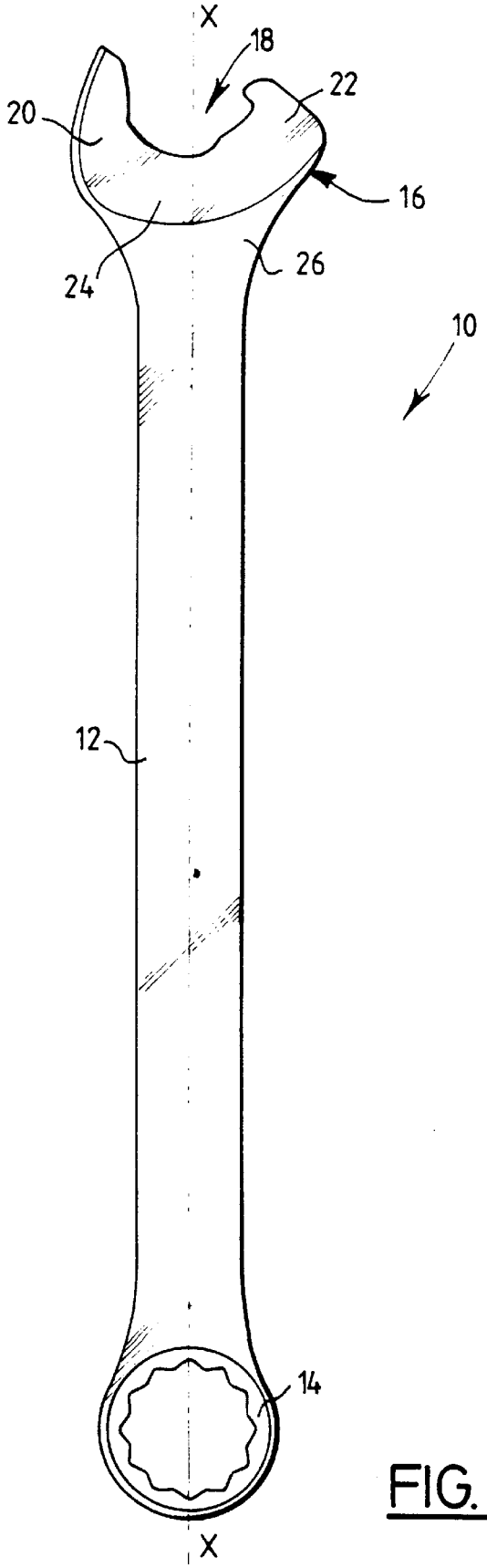
FIG. 1 is an elevational view of a ratcheting wrench according to the invention.

The ratcheting wrench 10 represented in FIG. 1 comprises a flat body having an axis X—X, forming an actuating arm.

It is provided at one of its ends with a box driving head 14 and at its other end with a ratcheting driving head 16 which has a fixed spacing.

Figure 2:
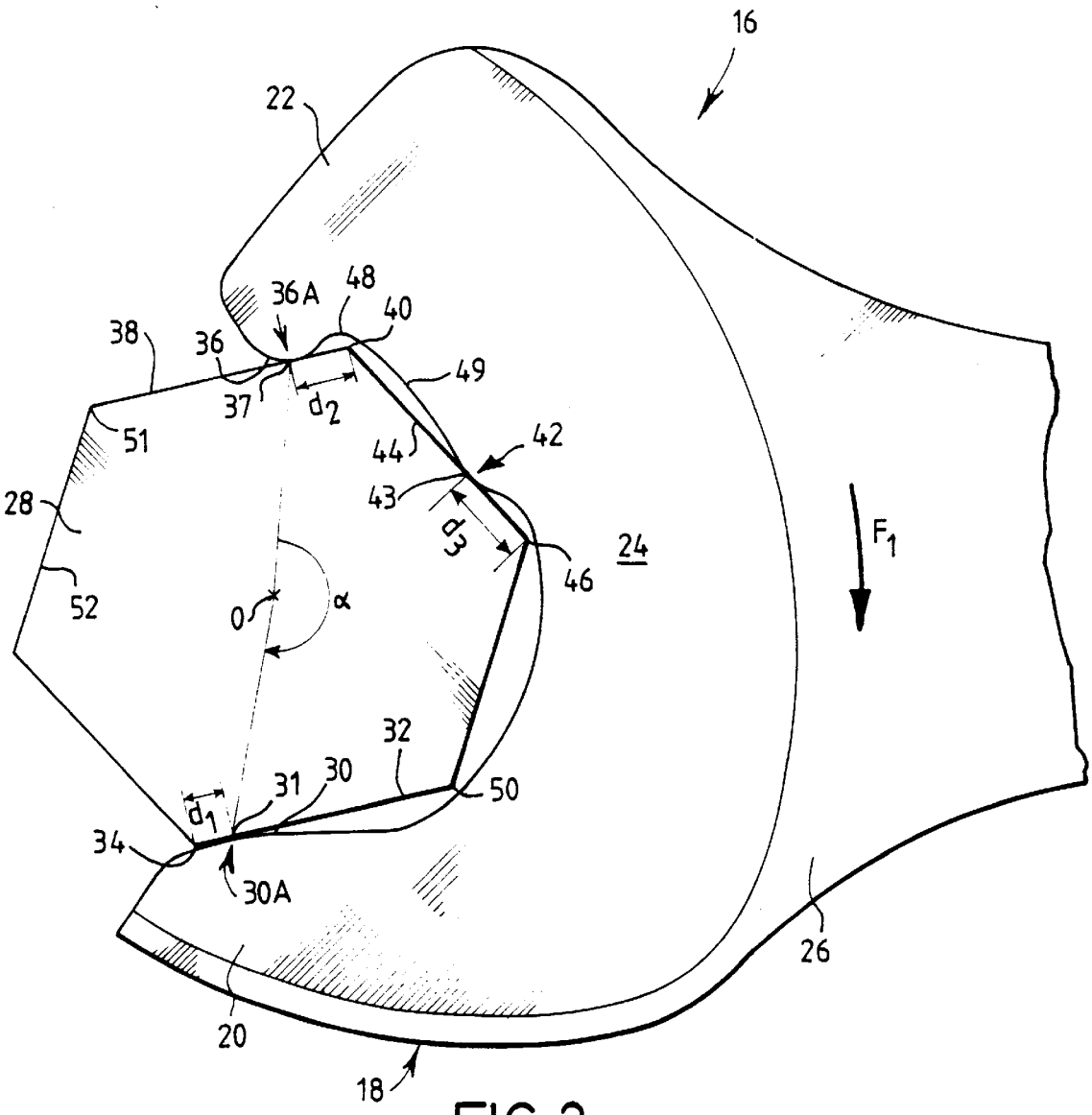
FIG. 2 is an elevational view of the driving head of the wrench of FIG. 1, represented in a position for driving a hexagonal member.
Figure 3:
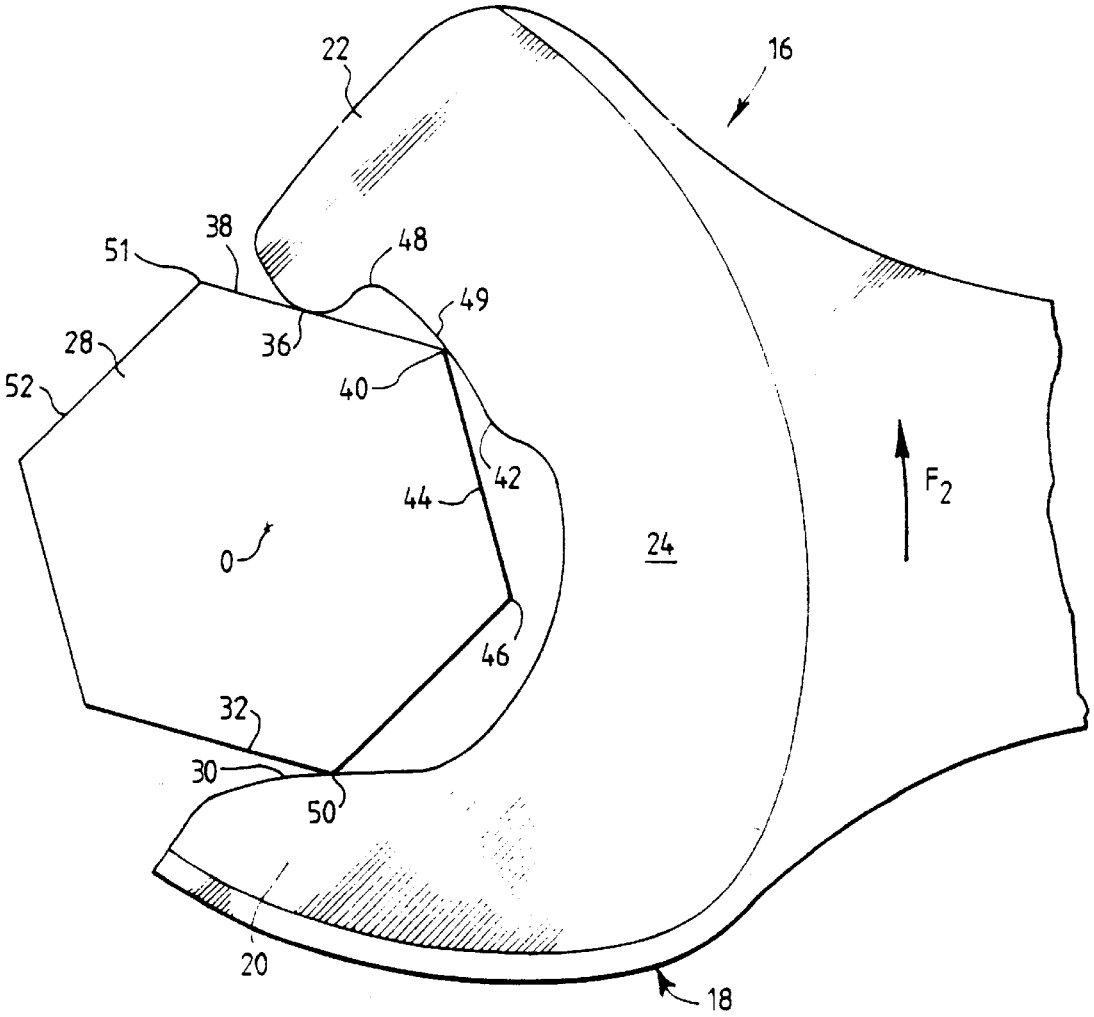
FIG. 3 is an elevational view of the driving head of the same wrench, represented in the stage of a return about the hexagonal member.

The ratcheting driving head 16, represented in detail in FIGS. 2 and 3, is formed essentially of an open jaw structure 18 in the extension of the body 12.

It is defined by two opposed jaws 20 and 22 of unequal length. These two jaws are interconnected by an arch 24 which is set back and connected to the body 12 by a section 26 whose width progressively decreases in the direction toward the body 12.

Represented in FIG. 2 is a driving hexagonal element 28 of a bolt head engaged in the jaw structure of the head 16. The wrench is here represented in the driving position.

The jaw 20, constituting the front jaw, relative to the driving direction corresponding to the direction of the arrow F1, is longer than the jaw 22. It comprises a curved convex front driving surface 30. This front driving surface is adapted to cooperate with a front face 32 of the driving profile of the hexagonal element 28. More particularly, the surface 30 is so disposed on the jaw 20 as to bear against a point 31 of the front half of the front face 32, relative to the driving direction.

Further, the point 31 of contact of the driving surface 30 with the front face 32 is situated at a distance d1 from the front corner 34 of the face 32.

Likewise, the jaw 22, forming the rear jaw relative to the driving direction, comprises a curved convex rear driving surface 36. It is adapted to cooperate with the face 38 of the hexagonal element opposite relative to the front face 32. The point 37 of contact of the driving surface 36 with the rear face 38 is situated in the front half of this rear face relative to the driving direction. It is placed at a distance d2 from the front corner 40 of the rear face 38.

The front and rear driving surfaces 30 and 36 are formed by protuberances 30A, 36A in one piece or integrally with the front and rear jaws 20 and 22, respectively. Further, the radius of curvature of the protuberance 30A carrying the front driving surface 30 is much larger than the radius of curvature of the protuberance 36A carrying the rear driving surface 36. By way of example, the radius of curvature of the protuberance 30A is equal to about one half of the distance between the flats of the hexagonal element, while the radius of curvature of the protuberance 36A is equal to about one eighth of the distance between the flats of the hexagonal element.

The two driving surfaces 30 and 36 are so disposed that the distance d1 is less than the distance d2. In this way, the angle $\alpha$ at the center or hexagonal element (FIG. 2), measured in the driving direction, defined by the points of contact 31 and 37 is slightly greater than 180° and is for example equal to 183°. Depending on the manufacturing tolerances of the hexagonal element, the angle a is between 181° and 186°.

Further, there is provided on the arch 24 a curved convex protuberance 42 formed in one piece with the arch. This protuberance 42 is adapted to cooperate with an intermediate face 44 of the hexagonal driving profile 28. The intermediate face 44 is disposed in facing relation to the arch 24 between the front and rear faces 32 and 38. More precisely, the intermediate face 44 is situated immediately in front of the rear face 38 relative to the driving direction, and is connected to the latter by the corner 40.

The protuberance 42 is adapted to cooperate, when the wrench is placed in position and when a torque is applied to the hexagonal element 28, with a bearing point 43 of the intermediate face 44 situated in the front half of the latter relative to the driving direction, this being the case throughout the range of applied torques and in the absence of a torque.

Obviously, the bearing point 43 is in fact formed by a bearing segment extending throughout the thickness of the wrench.

The point of contact 43 is situated at a distance d3 from the front corner 46 of the intermediate face 44 which is greater than or equal to the distance d2. Further, it is situated in the vicinity of the front third, in particular between the front third and the front quarter, of the face 44, for a hexagonal element of maximum size, taking into account manufacturing tolerances.

The radius of curvature of the protuberance 42 is equal to about one quarter of the distance between the flats of the hexagonal element 28.

A rounded clearance 48 for receiving the corner 40 situated at the front of the rear face 38 is provided on the jaw 22, between the rear bearing surface 36 and the protuberance 42. This clearance 48 is provided immediately in front of the protuberance 36A. The latter and the clearance 48 have substantially equal and opposite radii of curvature and are tangentially connected to each other. The clearance 48 is made sufficiently deep to avoid any contact between the jaw 22 and the corner 40 regardless of the torque applied.

A concave connecting surface 49 tangentially connects the clearance 48 to the protuberance 42. This concave connecting surface has a radius of curvature that is less than or equal to the distance between the flats of the hexagonal element.

As represented in the Figures, the interior profile of the jaw structure 18 is formed, from its front end to its rear end, of a succession of tangentially interconnected curved portions. Further, as represented in FIG. 2, outside the bearing point 43, the connecting arch is completely spaced away from the hexagonal element 28 in the driving position, regardless of the torque applied and in the absence of torque.

It will be understood that, when a torque is applied in the direction of arrow F1 (FIG. 2), and regardless of its value, there are three points of contact between the wrench and the hexagonal element, all situated in the front half of the corresponding three faces of the hexagonal element. This arrangement ensures an optimal and stable application of the tightening torque. The bearing point 43 guides the wrench throughout the thickness of the latter so that the latter tends to remain perpendicular to the axis of the bolt during the tightening.

Moreover, the bearing point 43 acts as a guide and a precise abutment for the wrench when it is laterally engaged on the hexagonal element.

It will also be noted that if an excessive torque is applied on the wrench, the force with which the wrench bears on the hexagonal element at the point 43 increases and an escape occurs in a damped fashion, which improves safety during use.

Further, the angular offset, relative to the axis O, between the points of contact 37, 43 and 31 distributes the forces distinctly to the rear of the three corners of the hexagonal element. Consequently, no corner is stressed preferentially or directly, so that none of them is subject to premature wear.

Further, as the distance d2 is larger than the distance d1, the rear driving surface 36, notwithstanding its relatively small radius of curvature, cannot damage the corner 40, since the zone of application of the force is situated at a sufficient distance d2 from this corner. Thus the small radius of curvature of the rear surface 36 relative to the front surface 30 is compensated by the fact that the distance d2 is greater than the distance d1.

Represented in FIG. 3 is the head 16 of the ratcheting wrench in the return or repeat position. This return is achieved by moving the wrench in the direction of the arrow F2, opposite to that of the arrow F1, about the hexagonal element 28. In the course of the return, the driving surface 36 of the rear jaw 22 travels along the rear face 38. In this way, the front jaw 20, and in particular its front driving surface 30, disengages from the front face 32 and travels beyond the rear corner 50 of the latter. Under these conditions, the surface 36 travels around the rear corner 51 of the rear face 38 and comes to bear against the face 52 of the hexagonal element situated immediately to the rear of the rear face 38.

It will be understood that the application of the driving surface 36 on the face 52 again permits the driving of the hexagonal element in the direction of arrow F1 in the manner explained hereinbefore.

Alternating and successive angular movements of the driving head 16 in the direction of the arrows F1 and F2 thus permit the driving of the hexagonal element 28 (in the direction of the arrow F1) with no need to completely disengage the driving head 16 from the driving profile of the hexagonal element 28 in the repeat stages.

Further, the relatively large angular spacing apart of the three points of contact of the driving surfaces 31, 37, 43 on the hexagonal element affords good stability of the wrench upon the application of the torque in the plane perpendicular to the axis of the hexagonal element and in the absence of torque.

Moreover, the box driving head 14 provided at the other end of the body 12 of the wrench may be replaced by a ratcheting driving head of the same type as that placed at the first end but of a different size.

In the embodiment described with reference to the drawings, the point of contact 43 is situated between the front third and the front quarter of the face 44 for a hexagonal element of maximum size.

However, in a variant not represented, the point of contact 43 is situated substantially between the half and the front third of the face 44 for a hexagonal element of maximum (or nominal) size. In particular, the point of contact is established on the nut substantially at the front four tenths of the intermediate face 44 (that is to say with d3 close to 0.4 times the nominal length of the face 44).

What is claimed is:

1. A ratcheting wrench for driving a device having a head with a hexagonal driving profile comprising six flat faces and six corners defined by said flat faces, said wrench comprising:

an open jaw structure comprising and defined by a front jaw, a rear jaw, relative to the driving direction, and an arch interconnecting said front and rear jaws, each of said jaws comprising a driving surface for cooperation with a front face and a rear face, respectively, of said driving profile in a front half of said faces relative to said driving direction, said front and rear faces being in opposed relation to each other in said hexagonal profile, said open jaw structure further comprising on said arch a curved convex bearing protuberance for cooperating, in the absence of torque and throughout the range of the applied driving torques, with a bearing point on an intermediate face of said driving profile situated immediately in front of said rear face relative to said driving direction, said bearing point of said intermediate face being situated in a front half of said intermediate face, in the absence of torque and in the range of the applied driving torques, and said arch being, in the driving position of said jaw structure, completely spaced away from said driving profile, other than at said bearing point, in the absence of torque and during the application of said driving torque.

2. A ratcheting wrench according to claim 1, wherein said protuberance cooperates with said intermediate face in the vicinity of the front third of said intermediate face, relative to said driving direction, for a head of maximum size.

3. A ratcheting wrench according to claim 1, wherein the distance between a region of contact of said rear driving surface with said rear face and the front corner of said rear face, relative to said driving direction, is less than the distance between said bearing point of said protuberance with said intermediate face and the front corner of said intermediate face relative to said driving direction.

4. A ratcheting wrench according to claim 1, wherein said protuberance is formed in one piece with said arch.

5. A ratcheting wrench according to claim 1, comprising on said arch, between said rear driving surface and said protuberance, a recess and a concave surface which extends and connects said recess to said protuberance and has a radius of curvature which is less than or equal to than a distance between said flat faces of said hexagonal profile, thereby avoiding any contact between said jaw structure and said front corner of said rear face.

6. A ratcheting wrench according to claim 1, wherein said front and rear driving surfaces are curved convex surfaces.

7. A ratcheting wrench according to claim 6, wherein said rear driving surface has a radius of curvature which is less than a radius of curvature of said front driving surface.

8. A ratcheting wrench according to claim 1, wherein an angle $\alpha$ measured in said driving direction and defined between the axis of rotation of said hexagonal driving profile and the two regions of contact between said hexagonal profile and said rear driving surface and front driving surface is slightly greater than 180°.

9. A ratcheting wrench according to claim 1, wherein said jaw structure has a profile which is formed by a succession of tangentially-interconnected curved portions from said front driving surface to said rear driving surface.

10. A ratcheting wrench according to claim 1, wherein said jaw structure is disposed at one end of a wrench body which is provided at its other end with a ratcheting driving jaw structure, which is of the same type and of another size as said jaw structure disposed at the one end of said wrench body.

11. A ratcheting wrench according to claim 1, wherein said jaw structure is disposed at one end of a wrench body which is provided at its other end with a box wrench head.

12. A ratcheting wrench according to claim 1, wherein said jaw structure has a fixed spacing between said front and rear jaws.

13. A ratcheting wrench according to claim 1, wherein said protuberance cooperates with said intermediate face at a place situated between one half and the front third of said intermediate face, relative to said driving direction, for a head of maximum size.

14. A ratcheting wrench according to claim 1, wherein said protuberance cooperates with said intermediate face substantially at a place situated at the front four tenths of said intermediate face, relative to said driving direction, for a head of maximum size.

* * * * *